US009353671B2

(12) United States Patent
Speretta et al.

(10) Patent No.: US 9,353,671 B2
(45) Date of Patent: May 31, 2016

(54) FAN UNIT FOR A HEAT EXCHANGER

(71) Applicant: Johnson Electric S.A., Murten (CH)

(72) Inventors: Gianni Speretta, Asti (IT); Daniele Dal Colle, Asti (IT)

(73) Assignee: JOHNSON ELECTRIC S.A., Murten (CH)

( * ) Notice: Subject to any disclaimer, the term of this patent is extended or adjusted under 35 U.S.C. 154(b) by 263 days.

(21) Appl. No.: 13/715,227

(22) Filed: Dec. 14, 2012

(65) Prior Publication Data

US 2013/0153181 A1 Jun. 20, 2013

(30) Foreign Application Priority Data

Dec. 15, 2011 (IT) ..... TO2011U0140

(51) Int. Cl.
*F01P 5/06* (2006.01)
*F04D 19/00* (2006.01)
*F04D 25/08* (2006.01)

(52) U.S. Cl.
CPC ..... *F01P 5/06* (2013.01); *F04D 19/002* (2013.01); *F04D 25/082* (2013.01)

(58) Field of Classification Search
CPC ..... F04D 25/08; F04D 25/082; F04D 25/14; F04D 29/083
USPC ..... 417/423.1, 423.7, 423.9, 423.14, 417/423.15; 310/86, 104, 88
See application file for complete search history.

(56) References Cited

U.S. PATENT DOCUMENTS

| | | | | |
|---|---|---|---|---|
| 6,342,741 | B1 * | 1/2002 | Fukui et al. | 310/60 A |
| 6,384,494 | B1 * | 5/2002 | Avidano et al. | 310/58 |
| 7,132,772 | B2 * | 11/2006 | Takeuchi et al. | 310/88 |
| 2004/0164633 | A1 * | 8/2004 | Misaki | 310/91 |
| 2011/0074254 | A1 * | 3/2011 | Critchley et al. | 310/60 R |

* cited by examiner

*Primary Examiner* — Justin Jonaitis
*Assistant Examiner* — Stephen Mick
(74) *Attorney, Agent, or Firm* — Muncy, Geissler, Olds & Lowe, P.C.

(57) ABSTRACT

A fan unit for a heat exchanger, has a plate-like support structure or shroud with a main opening defining an air passage for ventilation of the heat exchanger. An electric drive motor is fixed to the support structure or shroud. An impeller is arranged inside the main opening and driven by the drive motor. A spray protection screen associated with a side of the motor remote from the impeller is fixed to the support structure or shroud in such a way that, during use, it is substantially vertical and defines an inlet opening for an air flow for cooling the motor. The spray protection screen has an outwardly projecting deviating formation designed to deflect outside of the inlet opening, water which may flow over the outer surface of the screen during operation of the fan unit.

7 Claims, 2 Drawing Sheets

FAN UNIT FOR A HEAT EXCHANGER

CROSS REFERENCE TO RELATED APPLICATIONS

This non-provisional patent application claims priority under 35 U.S.C. §119(a) from Patent Application No. TO2011U000140 filed in Italy on Dec. 15, 2011.

FIELD OF THE INVENTION

This invention relates to a fan unit for a heat exchanger and in particular, to a fan unit for a heat exchanger of a radiator for a motor vehicle.

BACKGROUND OF THE INVENTION

More specifically the invention relates to a fan unit of the type comprising: a plate-like support structure or shroud which has a main opening defining a passage for an air flow for ventilation of the exchanger; and an electric fan including an electric drive motor fixed to the support structure or shroud in the region of the main opening, and an impeller with blades arranged inside the main opening and connected to the drive motor. A spray protection screen is associated with the side of the motor remote from the impeller and is fixed to the support structure in such a way that, during use, it is substantially vertical and defines at the bottom at least one inlet opening suitable for being passed through, during operation, by an air flow for cooling the motor.

In fan units of this type manufactured hitherto it is possible that, during operation, in the event of rain, a stream of water may flow along the outer surface of the spray protection screen and be sucked up so that it passes over the electric motor driving the fan impeller. This, of course, is undesirable.

Hence there is a need for an improved fan unit of the type specified above which is able to overcome the abovementioned drawback of the fan units according to the prior art.

SUMMARY OF THE INVENTION

This is achieved in the present invention by using an outwardly projecting deviating formation designed to deflect outside of the inlet opening the water which during operation flows over the outer surface of the screen.

Accordingly, in one aspect thereof, the present invention provides a fan unit for a heat exchanger, comprising: a plate-like support structure or shroud which has a main opening defining a passage for an air flow for ventilation of the heat exchanger; and an electric fan including an electric drive motor fixed to the support structure or shroud in the region of the main opening, and an impeller with blades, which is arranged inside the main opening and connected to the drive motor; and a spray protection screen associated with the side of the motor remote from the impeller and fixed to the support structure or shroud in such a way that, during use, it is substantially vertical and defines at the bottom thereof at least one inlet opening suitable for being passed through, during operation, by an air flow for cooling the drive motor, wherein the spray protection screen has an outwardly projecting deviating formation designed to deflect outside of the inlet opening, water which during operation may flow over the outer surface of the screen.

Preferably, the deviating formation has an essentially channel or gutter like form.

Preferably, the channel-like deviating formation extends along a curved path having an upwardly directed convexity.

Preferably, the deviating formation is integrally formed with the screen, as a single piece monolithic structure.

Preferably, the fan unit is used as a cooling fan module to cool a radiator of a vehicle.

Optionally, the cooling fan module is disposed within an engine compartment of said vehicle.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENT

Figure 1:
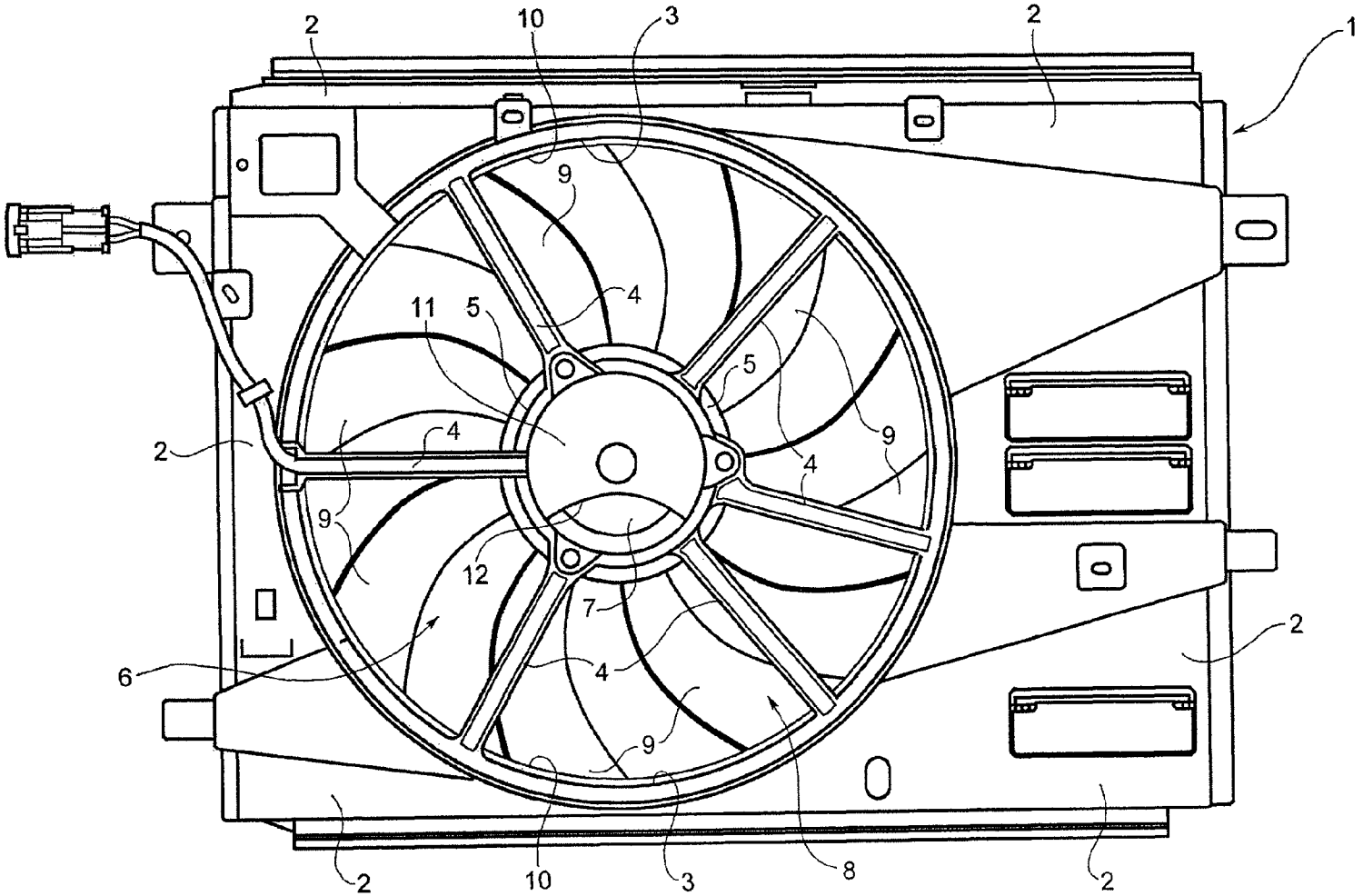
FIG. 1 is a rear elevation view of a fan unit for a heat exchanger according to the preferred embodiment of the present invention.
Figure 2:
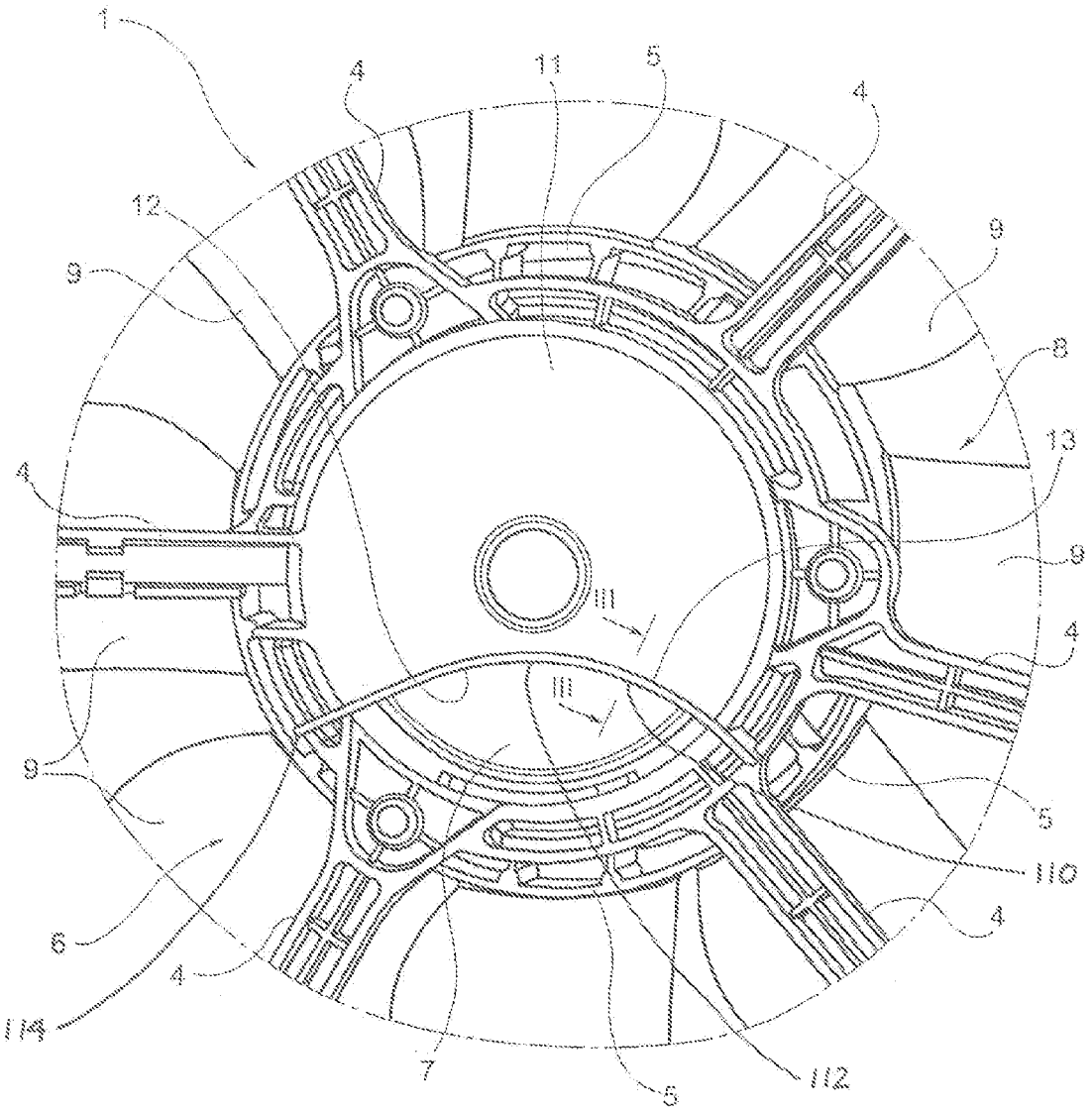
FIG. 2 is a view, on a larger scale, of part of FIG. 1.
Figure 3:
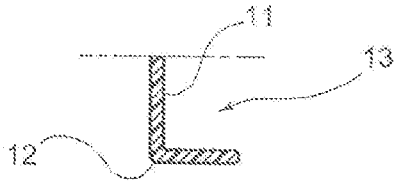
FIG. 3 is a cross-sectional view along the line III-III of FIG. 2.

In FIGS. 1 and 2, reference number 1 denotes in its entirety a fan unit for a heat exchanger (not shown), such as a radiator of a motor vehicle. In a manner known per se, the fan unit 1 comprises a plate-like support structure, or shroud, 2, which is made of moulded plastic. The support structure or shroud 2 has a main opening 3 defining a passage for air to flow.

In the embodiment shown by way of example, a plurality of spokes 4 extend from the edge of the main opening 3 and are connected to a central annular support element 5. An electric fan, denoted overall by 6, is fixed to the annular support element 5. The fan 6 comprises an electric drive motor 7 which is fixed to the annular support element 5 and an impeller 8 having a plurality of shaped blades 9, the remote ends of which are connected to an outer ring 10 (FIG. 1).

A spray protection screen 11 is associated with the rear side of the motor 7, i.e. the side opposite to that of the impeller 8, being fixed to the annular support element 5 of the plate-like structure or shroud 2. The arrangement is such that, during use, the spray protection screen 11 is substantially vertical. The screen 11 defines at the bottom (at least) one inlet opening 12 which is intended during operation to be passed through by an air flow for cooling the motor 7, this flow being directed from the rear part towards the front part of this motor.

According to the present invention, the spray protection screen 11 has an outwardly projecting deviating formation 13 which is designed to deflect outside of the inlet opening 12 the water which during operation may flow over the outer surface of this screen 11. This deviating formation 13 conveniently has an essentially channel or gutter like form.

As can be seen more clearly in FIG. 2, advantageously, the channel-like deviating formation 13 is formed by outwardly extending a non-closed curved path 110 of the spray protection screen 11 towards an orientation away from the motor 7. In one embodiment, a center 112 of the non-closed curved path 110 is raised relative to two ends 114 of the non-closed curved path 110. A sectional view of the outwardly projecting deviating formation 13 along a plane substantially parallel to a surface of the spray protection screen 11 is a non-closed are shaped. The outwardly projecting deviating formation 13 is formed on the spray protection screen 11 away from a center of the spray protection screen 11. Two opposing ends of the outwardly projecting deviating formation 13 are extended over an edge of the spray protection screen 11.

As a result of this form, the water which during operation may flow over the outer surface of the screen 11 is essentially divided into two streams which are deflected outside of the inlet opening 12, namely on the left-hand side and right-hand side of the opening 12, when viewing FIG. 2.

The projecting deviating formation 13 is conveniently formed integrally, i.e. as a single piece monolithic structure, with the spray protection screen 11, being made for example of moulded plastic or metal.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. Fan unit for a heat exchanger, comprising:

a plate-like support structure which has a main opening defining a passage for an air flow for ventilation of the heat exchanger;

an electric fan including an electric drive motor fixed to said support structure or shroud in the region of said main opening, and an impeller with blades, which is arranged inside said main opening and connected to said drive motor; and a spray protection screen associated with a side of the motor remote from the impeller and fixed to said plate-like support structure in such a way that, during use, it is substantially vertical and defines a single inlet opening at a position below a center of said spray protection shield and extending to an edge of said spray protection shield, suitable for being passed through, during operation, by an air flow for cooling the motor, wherein the spray protection screen has an outwardly projecting deviating formation forming an upper boundary of the inlet opening and extending over the edge of the spray protection screen and having an essentially channel-like form designed to deflect outside of said inlet opening water which during operation may flow over the outer surface of said spray protection screen; and wherein a sectional view of the outwardly projecting deviating formation along a plane substantially parallel to a surface of the spray protection screen is concave downwardly non-closed arc shaped.

2. The fan unit of claim 1, wherein said outwardly projecting deviating formation is integrally formed with said spray protection screen, as a single piece monolithic structure.

3. The fan unit of claim 1, when used as a cooling fan module to cool a radiator of a vehicle.

4. The fan unit of claim 3, wherein the cooling fan module is disposed within an engine compartment of said vehicle.

5. The fan unit of claim 1, wherein the outwardly projecting deviating formation is formed by outwardly extending a non-closed curved path of the spray protection screen towards an orientation away from the motor.

6. The fan unit of claim 5, wherein a center of the non-closed curved path is raised relative to two ends of the non-closed curved path.

7. The fan unit of claim 5, wherein said outwardly projecting deviating formation is integrally formed with said spray protection screen, as a single piece monolithic structure.

* * * * *